US005529416A

United States Patent [19]

Favre

[11] Patent Number: 5,529,416

[45] Date of Patent: Jun. 25, 1996

[54] NON-CIRCULAR CROSS-SECTION DISPENSER FOR PASTRY STICK PRODUCTS

[75] Inventor: Bernard Favre, Sceaux, France

[73] Assignee: Lir France, Chevilly-Larue, France

[21] Appl. No.: 275,699

[22] Filed: Jul. 7, 1994

[30] Foreign Application Priority Data

Jul. 9, 1993 [FR] France ..... 93 08522

[51] Int. Cl.[6] ..... A45D 40/06; A45D 40/00

[52] U.S. Cl. ..... 401/68; 401/75; 401/98; 401/172; 401/175; 401/213; 215/334

[58] Field of Search ..... 401/75, 175, 68, 401/171, 172, 69, 98, 213; 215/334

[56] References Cited

U.S. PATENT DOCUMENTS

| | | | |
|---|---|---|---|
| 102,024 | 4/1870 | McCully | 215/334 |
| 299,044 | 5/1884 | Wilson | 215/334 |
| 2,626,047 | 1/1953 | Crane | 401/69 |
| 4,135,831 | 1/1979 | Reitknecht | 401/175 |
| 4,664,547 | 5/1987 | Rosenwinkel | 401/175 |
| 5,111,972 | 5/1992 | Sakurai et al. | 401/68 X |

FOREIGN PATENT DOCUMENTS

| | | |
|---|---|---|
| 57554 | 2/1953 | France . |
| 2573734 | 5/1986 | France . |

*Primary Examiner*—Steven A. Bratlie
*Attorney, Agent, or Firm*—Pennie & Edmonds

[57] ABSTRACT

A dispensing packing in particular for a stick-shaped cosmetic pasty product, comprising a hollow body, a product-carrying piston axially movable but held against rotation in the hollow body, a screw for the axial displacement of the piston and a knurled member for rotating the screw, the hollow body exhibiting a non-circular for example oval cross-section, the means for rotating the knurled member comprising an endless tape mounted on the lower end of the body and displaceable in the peripheral direction thereof and comprising on its inner surface projecting elements co-operating with the driving elements on the outer surface of the knurled member to rotate the latter upon the displacement of the tape whereas the hollow body comprises at the level of the driving tape openings permitting the engagement of the complementary driving elements of the knurled member and of the tape.

8 Claims, 2 Drawing Sheets

NON-CIRCULAR CROSS-SECTION DISPENSER FOR PASTRY STICK PRODUCTS

TECHNICAL FIELD

The present invention relates to a dispenser or to a dispensing container or packing, in particular for a stick-shaped pasty product, comprising a hollow body, a piston carrying the said product and mounted for axial motion but held against rotation within the hollow body and provided with a threaded portion, a device for the axial displacement of the said piston comprising a screw which extends axially within the body and co-operates with the threaded portion of the piston, and means for rotating the screw which comprises a member such as a knurled part made fast to the screw for unitary rotation therewith and arranged in the lower portion of the hollow body and carrying on its external face elements allowing it to be rotatably driven.

BACKGROUND ART

In known dispensing packings, the hollow body exhibits a substantially cylindrical shape with a circular cross-section and the driving member is shaped as a knurled part for rotating the screw, which causes the axial displacement of the piston. The driving member is mounted at the lower end of the body in axially aligned relationship with the latter and exhibits an external cylindrical shape corresponding to that of the hollow body so that its external peripheral surface extends that of the body. It is thus easy to manually turn the knurled pat since the elements for rotary driving of the latter are freely accessible.

Known dispensing packing have major inconvenience in that these component elements and devices require a cylindrical shape with a circular cross-section.

SUMMARY OF THE INVENTION

The object of the present invention is to provide a dispensing packing which may have other than circular, for example oval, shape.

To attain this goal the distributing packing according to the invention is characterized in that the means for rotatably driving the knurled part comprises an endless tape or strip which is mounted onto the lower end of the body, is displaceable in the direction of the periphery of the latter and comprises on its inner surface projecting elements which co-operate with the drive elements on the outer surface of the knurled part to rotate the latter upon the displacement of the tape or strip and in that the hollow body at the level of the driving tape or strip comprises openings permitting the engagement of the complementary driving elements of the tape or strip and of the knurled part.

BRIEF DESCRIPTION OF THE DRAWINGS

The invention will be better understood and further objects, characterizing features, details and advantages thereof will appear more clearly as the following explanatory description proceeds with reference to the accompanying diagrammatic drawings. These are given by way of example only to illustrate a presently preferred specific embodiment of the invention in which.

DETAILED DESCRIPTION OF THE PREFERRED EMBODIMENTS

Figure 1:
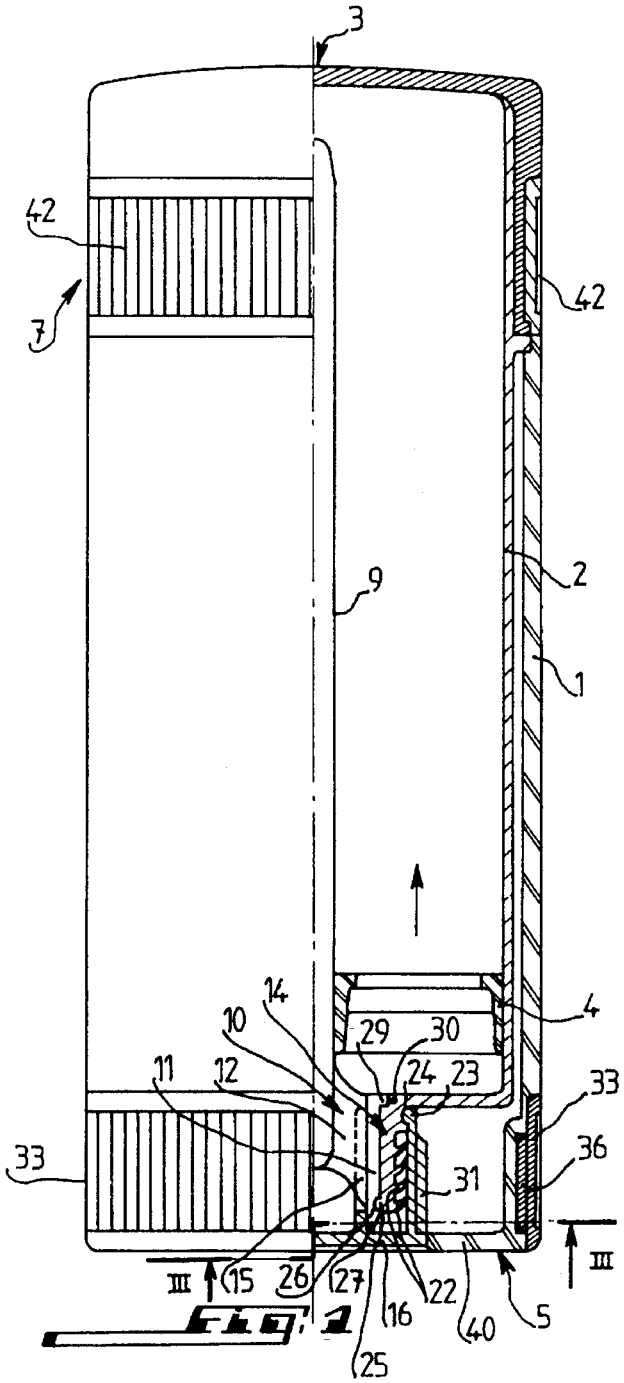
FIG. 1 is a side view partially in section in the longitudinal plane of the major axis of a dispensing packing with an oval shape according to the present invention.

Referring to the figures, it is evident that the dispensing packing shown by way of example and in particular designed for any stick-shaped pasty product whatsoever such as a deodorant stick essentially comprises an outer hollow body 1 having an elongated cylindrical shape with an oval cross-section, an inner body 2 shaped as a tubular casing and adapted to be placed inside of the body 1 and also having an oval shape, a cap or like cover 3 adapted to close the packing with a fluid tight seal at its upper end, a piston 4 axially displaceable inside of the inner body 2 also having an oval shape and adapted to carry the stick (not shown) as well as an assembly 5 which is mounted in the lower end of the packing and adapted to close the latter with a fluid-tight seal at this end and to provide the axial displacement of the piston 4. The various parts which constitute the packing are advantageously made from plastic materials of any suitable nature in accordance with the desired rigidity or stiffness.

Figure 5:
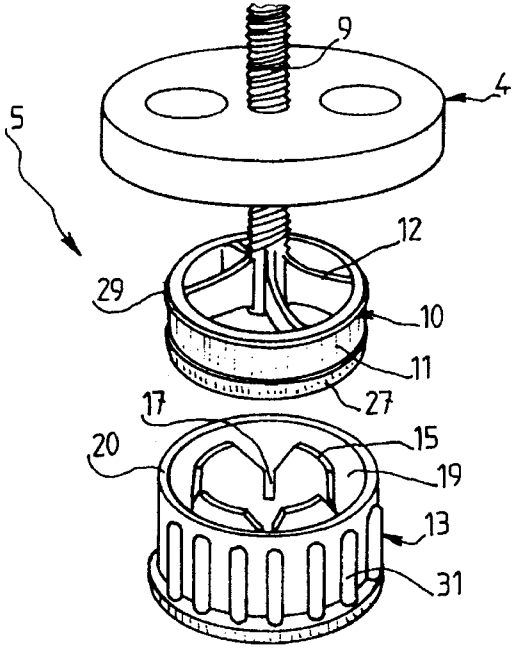
FIG. 5 is a perspective exploded view of the members necessary for the displacement of the piston carrying the product to be dispensed.
Figure 5:
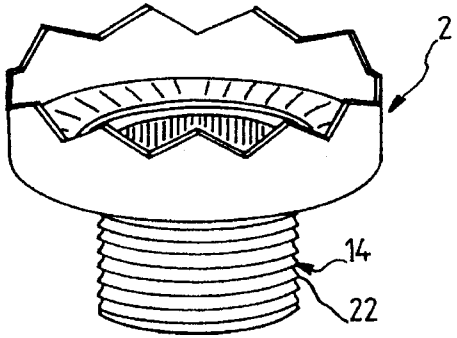
Figure 4:
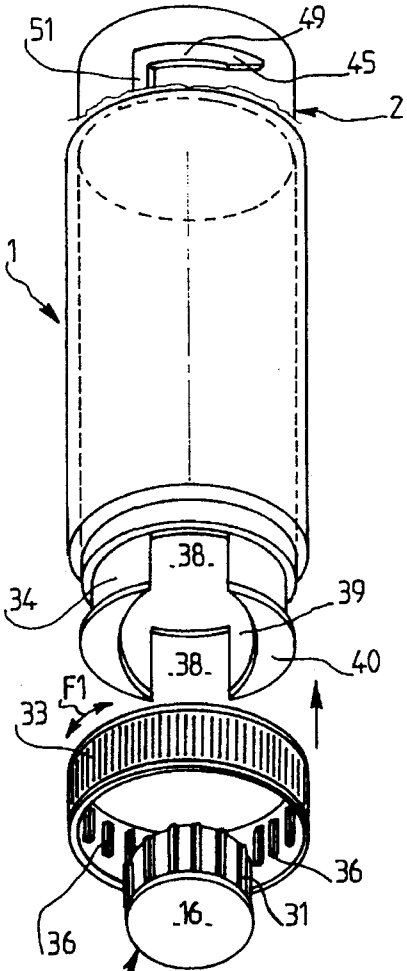
FIG. 4 is a perspective exploded view of a number of essential component parts of the packing according to FIG. 1.

The assembly 5 is a relatively complex structure as exhibited in FIGS. 4 and 5. In particular, it comprises a device for the axial displacement of the piston 4 in translatory motion, which comprises a screw 9 extending along the axis of the packing and provided at its lower end with a ring-shaped hub 10 fastened to the screw for rotation therewith by spokes 12 and a hollow knurled part 13 of cylindrical shape with a circular cross-section, closed at its lower end by a bottom wall 16 and open at the top and which may be fastened to the ring-shaped hub 10 for rotation therewith and is adapted to accommodate a fluid-tight seal with the lower end of the inner body 2 which for that purpose comprises a cylindrical portion 14.

More specifically the knurled part 13 comprises a coaxial inner ring 15 which extends from the bottom wall 16 and is provided with axial notches 17 adapted to receive each one of the spokes 12 of the hub 10 when the latter engages an annular space 19 formed between an outer wall 20 of the knurled part 13 and the ring 15. As shown in particular on FIGS. 1 to 3, the lower cylindrical portion 14 of the inner body 2 also engages this annular space 19. This portion 14 carries on its outer peripheral surface a number of coaxial and axially spaced collars 22 which form sealing lips and are caused to contact the inner surface of the wall 20 of the knurled part. To carry out the assembly of the knurled part 13 onto the portion 14 of the inner body, the knurled part comprises at its upper open end a rib 23 which projects radially inwards and engages a complementary circular groove 24 formed in the portion 14 at the level of the root of the latter. This portion 14 moreover comprises at its lower open end a rib 25 which projects radially inwards and engages a complementary rib 26 formed in the outer peripheral surface of the hub 10 and defined towards the end by an assembly collar 27 which projects radially outwards. The upper end of the hub also carries a shoulder 29 which projects radially outwards and engages a circular recess 30 of the inner body 2. As to the knurled member 13, it should be further stated that it carries on the outer peripheral surface tooth-shaped axial elements 31 which are regularly distributed about the periphery and form elements allowing the knurled member to be rotatably driven.

The device for rotatably driving the knurled member 13 comprises an endless tape or strip 33 which forms a loop made from a flexible material and surrounds the lower end of the outer body 1. For that purpose the latter comprises a peripheral guide groove 34 engaged by the tape or strip 33 which is guided so that it may perform a displacement in the direction of its longitudinal axis in the direction of the double arrow F1. The tape carries on its inner surface tooth-shaped projecting elements 36 which extend parallel to the teeth 31 of the knurled member 13 and form a toothing complementary to or mating with that of the knurled member providing for meshing engagement therewith. In order that the teeth 36 of the tape 33 may engage the teeth 31 of the knurled member 13, the wall forming the bottom of the guide groove 34 comprises at the level of its minor axis two slots or like openings 38. As shown in particular in FIG. 4, when the knurled member 13 is inserted through a circular opening 39 formed in an oval closure wall 40 of the lower end of the outer body 1 so that its bottom wall 16 is in the plane of the wall 40, the mutual engagement of the teeth 36 and 31 of the tape 33 and of the knurled member 13, respectively, takes place. When the tape is caused to e displaced on the lower end of the body 1, it rotates the knurled member 13 thereby causing the rotation of the screw 9 and thus the axial displacement of the piston 4.

Figure 2:
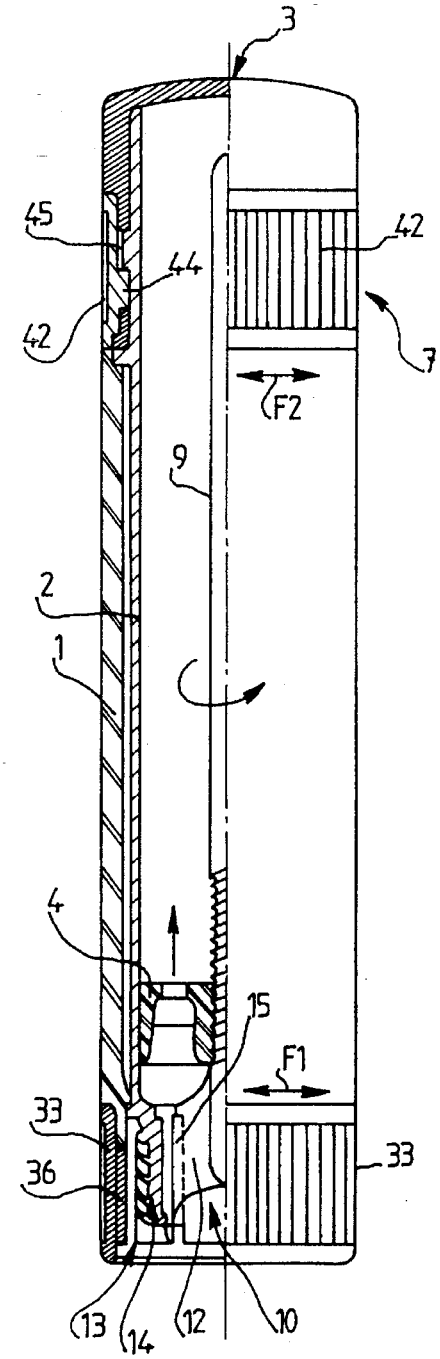
FIG. 2 is a view similar to FIG. 1 in a plane perpendicular to that of FIG. 1.
Figure 3:
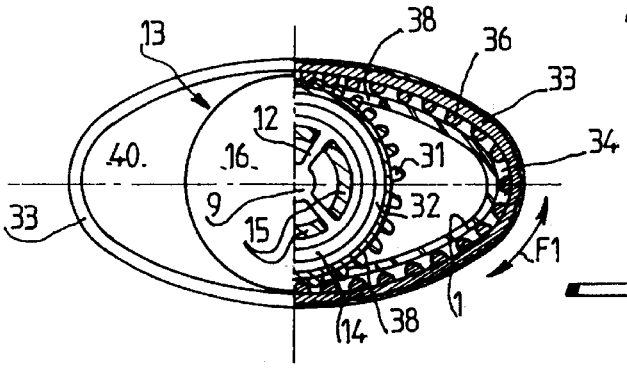
FIG. 3 is a bottom view of the packing according to FIG. 1 and in section taken upon the line III—III of FIG. 1.
Figure 6:
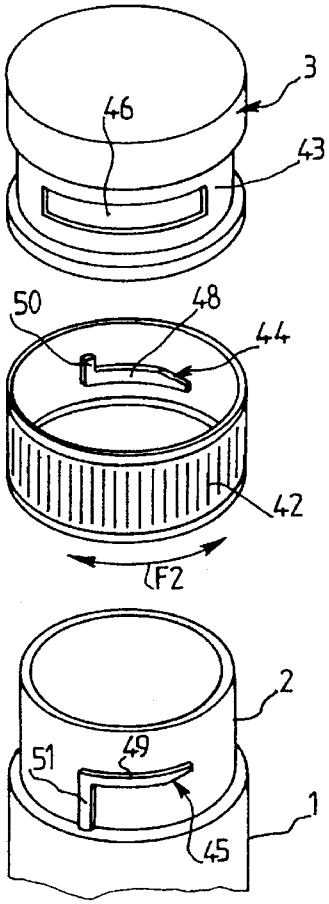
FIG. 6 is a perspective and exploded view showing those parts of the packing according to the invention which are intervening or operative for the closing of the packing at its upper end.

Referring to FIGS. 1, 2 and 6, it is seen that the cap 3 also exhibits an oval shape corresponding to that of the upper end of the inner body 2 so that it may be fitted onto said end in its closing position. A device 7 for locking the cap or cover 3 in its closing position essentially comprises an endless tape or strip 42 shaped as a loop, made from a flexible material and placed into an annular groove 43 which is formed in the outer peripheral surface of the wall of the cap or cover and extends at right angles to the axis of the packing all about the cap. This tape comprises on its inner surface two opposing locking ramps 44 adapted to co-operate with two complementary ramps 45 which are projecting from the outer peripheral surface of the inner body 2 so that they may engage with the ramps 44 upon the displacement of the tape 42 in the direction of the double arrow F2. In order that the ramps 44 and 45 may be caused to mutually engage each other, the bottom of the peripheral guiding groove 43 of the cap 3 comprises two slots 46 or like openings of suitable peripheral length and width.

Each of the ramps 44 and 45 comprise circumferential portion 48 and 49, respectively, and portions 50 and 51, respectively, which extend parallel to the axis of the packing. One end of the circumferential portions 48 and 49 of the ramps 44 and 45 exhibits an inclined profile. The displacement of the tape 42 in the direction of the arrow F2 causes, after putting the cap 3 in place on the end of the inner body to mutually engage the ramps, the cap to be axially displaced on the end of the body 2 toward the bottom wall 16 until it locks. The cap can be axially displaced away from the bottom wall 16 to a position allowing the cap to be disengaged. The portions 50 and 51 of the ramps define the end positions of the displacement of the tape.

It should be pointed out that in order to provide the fluid-tight closing of the cap, the upper end of the latter is adapted to seal tightly against the inner face at the bottom of the cap.

Regarding the operation of the dispensing packing, to provide for the axial displacement of the piston 4 carrying the stick of cosmetic product and for the locking of the cap, it suffices to suitably move the tapes 33 and 42, respectively. Since the tapes are flexible, the packing may have a different shape than the circular shape of the usual packings and also a different shape than the oval shape of the packing which has just been described with reference to the drawings.

Since the various component parts of the packing are made from plastic materials, all the projections, ribs, grooves and teeth or the like may be formed during the molding of these parts. The configuration of the parts such as is shown permits an easy assembling of the packing. The pasty stick can be molded inside of the packing by inserting the product from the lower end prior to putting the knurled member 13 in place. This member also constitutes the closure plug of the packing. The cap 3 should of course have been locked previously in its fluid-tight closing position onto the hollow body of the packing. As to the locking tapes, they are advantageously made from elastomers or from a flexible thermoplastic material and carry ergonomic boss beads or gadroons.

What is claimed is:

1. A dispensing packing particularly for a stick-shaped cosmetic pasty product, comprising:

a cylindrical tubular hollow body having a non-circular cross-section and upper and lower portions;

a piston carrying said product and mounted so as to be axially movable but held against rotation within the hollow body, said piston being provided with a threaded portion;

a driving device for causing the axial movement of said piston, comprising a screw extending axially within the body and co-operating with said threaded portion of the piston, and means for rotating said screw, comprising a gripping member secured to said screw for causing rotation thereof and arranged in the lower portion of said hollow body;

wherein said hollow body comprises an outer hollow body member having a non-circular cross-section, an open upper end and a lower end which is closed by a bottom wall having a circular opening therein, and an inner hollow body member having a shape corresponding to that of said external body member and being coaxially located within the latter but provided with a tubular lower portion having a circular cross-section and which is located coaxially with respect to the circular opening of said external body member above said opening;

said screw has an upper end and a lower end and carrying at its lower end a base member engaged coaxially in said tubular portion of said inner body member;

said gripping member having an upper end and a lower end closed by a bottom wall and adapted to be inserted through said circular opening in said external body member bottom wall and fitted onto said tubular portion of said inner body member and provided with means for rotatably securing said member to said screw base member within said tubular portion and an outer peripheral surface provided with means for rotatably driving said screw base member;

an endless tape is mounted on the lower end portion of said non-circular cross-section external body member, movably in the peripheral direction thereof and comprising on its inner face projecting drive elements engageable with said screw base driving means for rotatably driving the gripping member when said tape is moved in said peripheral direction;

said lower end portion of said external body member having openings through which said drive means of said endless tape extend for engagement with said screw base driving means for rotatably driving the gripping means.

2. A dispensing packing according to claim 1, wherein said screw base member comprises axial passageways therethrough whereby the pasty product can be introduced in the inner space of the packing through said opening in the bottom wall of the inner body member and said passageways before fitting said gripping member onto said circular cross-section portion of said inner body member so that said stick-like product can be molded in the interior of the packing.

3. A dispensing packing according to claim 1, wherein the said base member of said screw comprises a hub portion coupled to said lower end of said screw through spoke means and carrying on its outer surface means for its assembly to and its axial locking in the said circular cross-section of said inner body member.

4. A packing according to claim 3, wherein the gripping member has a knurled outer surface and comprises a cylindrical external wall having an upper open end and a lower end closed by said bottom wall and an internal coaxial ring portion extending from said bottom wall and provided with axially extending notches each adapted to receive a spoke of said hub portion when the gripping member is fitted onto the end of said circular cross-section portion of said inner body member for rotatably securing said gripping member to said hub portion.

5. A packing according to claim 1, wherein a peripheral groove for guiding the endless tape is provided in the outer face of the outer body at the level of the openings for the mutual engagement of the driving elements of the tape and of the gripping member.

6. A packing according to claim 1, wherein the cylindrical portion of the inner body comprises on its outer face collars which form sealing means between the cylindrical portion and the gripping member.

7. A packing according to claim 1, further comprising a cap for closing the packing and which exhibits a shape corresponding to that of the hollow body and is adapted to be fitted onto the upper open end thereof, whereas a tape for locking the cap onto the hollow body is mounted so as to be displaceable about the cap in the peripheral direction thereof, and which carries on its inner face ramp elements which are adapted to engage through openings in the wall of the cap with ramp elements provided on the peripheral surface of the hollow body so that the rotary motion of the locking tape causes an axial motion of the cap on the end of the hollow body.

8. A packing according to claim 7, wherein each ramp element has an L-shaped configuration and inclined portions to allow the cap to be engaged with and rotated and locked on the hollow body.

* * * * *